United States Patent [19]

Lelental et al.

[11] 4,374,916

[45] Feb. 22, 1983

[54] ELECTRICALLY CONDUCTIVE INTERLAYER FOR ELECTRICALLY ACTIVATABLE RECORDING ELEMENT AND PROCESS

[75] Inventors: Mark Lelental; Gary M. Goncher, both of Rochester, N.Y.

[73] Assignee: Eastman Kodak Company, Rochester, N.Y.

[21] Appl. No.: 325,270

[22] Filed: Nov. 27, 1981

[51] Int. Cl.[3] ..... G03G 17/00

[52] U.S. Cl. ..... 430/31; 430/351; 430/353; 430/52; 430/55; 430/417; 430/62

[58] Field of Search ..... 430/31, 52, 55, 351, 430/352, 417, 62

[56] References Cited

U.S. PATENT DOCUMENTS 3,615,414 10/1971 Light .
3,783,021 1/1974 York .
3,861,914 1/1975 Gange .
3,978,335 8/1976 Gibbons .
4,113,484 9/1978 Lelental et al. .
4,123,274 10/1978 Knight et al. .
4,128,557 12/1978 Knight et al. .
4,147,668 4/1979 Chiklis .
4,155,760 5/1979 Lelental et al. .
4,155,761 5/1979 Lelental et al. .
4,234,670 11/1980 Kaukeinen et al. .

OTHER PUBLICATIONS

*Research Disclosure,* Oct. 1979, Item No. 18627.
*Research Disclosure,* Jun. 1978, Item No. 17029.
"Neblette's Handbook of Photography and Reprography" edited by John M. Sturge, 7th Edition, 1977, pp. 120–121.
*Research Disclosure,* Dec. 1978, Item No. 17643.
*Research Disclosure,* Sep. 1978, Item No. 17326.

*Primary Examiner*—John D. Welsh
*Attorney, Agent, or Firm*—Richard E. Knapp

[57] ABSTRACT

In an electrically activatable recording element improvements are provided by an electrically conductive interlayer (ECI layer) separating (a) an electrically activatable recording layer from (b) a photoconductive layer or electrical activating means. The ECI layer comprises electrically conductive particles uniformly dispersed in an electrically insulating binder. The interlayer enables imaging with a minimized air gap between (a) and (b). The recording element is room light handleable. The element provides an image by dry development processing or by means of processing solutions.

24 Claims, 5 Drawing Figures

ELECTRICALLY CONDUCTIVE INTERLAYER FOR ELECTRICALLY ACTIVATABLE RECORDING ELEMENT AND PROCESS

BACKGROUND OF THE INVENTION

1. Field of the Invention

This invention relates to an electrically activatable recording element and process for using said element comprising an electrically conductive interlayer separating (a) an electrically activatable recording layer from (b) a photoconductor layer or electrical activating means. The interlayer, herein designated an ECI layer, comprises electrically conductive particles uniformly dispersed in an electrically insulating binder.

2. Description of the State of the Art

An electrically activatable recording material and process are described in, for example, U.S. Pat. No. 4,234,670. Production of a dye image and silver image in such a material by dry development techniques is described in copending U.S. Application Ser. No. 055,945, abandoned, of M. Lelental, filed July 9, 1979, titled "Dye Forming Electrically Activated Recording Material and Process", and commonly assigned with the present application to Eastman Kodak Company, and *Research Disclosure,* October 1979, Item 18627. Such an electrically activated recording element comprises, for example, an electrically conductive support, such as a poly(ethylene terephthalate) film having a cermet coating on the film, having thereon, in sequence, (a) an electrically activated recording layer comprising an organic silver salt and a reducing agent for the organic silver salt, and (b) a photoconductive layer separated from (a) by an air gap of up to 20 microns and (c) an electrically conductive layer on (b). Optionally, the electrically activatable recording layer (a) comprises, in reactive association, (A) a dye-forming coupler, and (B) an oxidation-reduction combination comprising (i) an organic silver salt oxidizing agent, with (ii) a reducing agent for the organic silver salt. The reducing agent, when oxidized, forms a dye with the dye-forming coupler. Such an electrically activated recording element enables formation of a dye image and silver image by heat processing after imagewise exposure and the application of electrical potential. It has been desirable to minimize the air gap between the electrically activatable recording layer and the photoconductor layer of an electrically activatable recording element because this enables formation of an integral electrically activatable recording element.

SUMMARY OF THE INVENTION

It has been found according to the invention that the air gap between (a) an electrically activatable recording layer and (b) a photoconductive layer or electrical activating means of an electrically activatable recording element is minimized with no loss in imaging by means of an interlayer separating (a) from (b). The interlayer (ECI layer) is electrically conductive and comprises electrically conductive particles, such as carbon particles, uniformly dispersed in an electrically insulating binder, preferably a pliable binder, such as a silicone rubber binder. During imagewise exposure, the electrically conductive interlayer permits the desired electric current or charge to pass from the exposed portions of the photoconductor layer to the electrically activatable recording layer in the image areas of the element. A polymeric interlayer that is merely electrically insulative is not useful. Also, a polymeric interlayer that is merely electrically conductive is not useful.

Optionally, the ECI layer is a self supporting film. The self supporting film is contiguous to the photoconductor layer and the electrically activatable recording layer during formation of a latent image in the electrically activatable recording layer. The ECI layer, in this alternative, is separable from the electrically activatable recording element.

An especially useful electrically activatable recording element according to the invention comprises an electrically conductive support having thereon, in sequence:

(a) a polymeric electrically active conductive (EAC) layer, (b) an electrically activatable recording layer, preferably comprising (A) a dye-forming coupler, and (B) an oxidation-reduction combination comprising (i) an organic silver salt oxidizing agent consisting essentially of a silver salt of a 1,2,4-mercaptotriazole derivative, especially such a derivative represented by the structure:

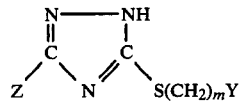

wherein Y is aryl containing 6 to 12 carbon atoms, m is 0 to 2; and, Z is hydrogen, hydroxyl, or amine, with (ii) a reducing agent which, in its oxidized form, forms a dye with the dye-forming coupler, (c) an ECI layer, (d) a photoconductive layer, and (e) an electrically conductive layer.

An image, such as a dye image and silver image, preferably a dye enhanced silver image, is produced in an electrically activatable recording element according to the invention by a process comprising the steps:

(I) imagewise altering the conductivity of the photoconductive layer in accord with an image to be recorded;

(II) applying an electrical potential across the photoconductive layer and the recording layer through the interlayer of a magnitude and for a time sufficient to produce a latent image in the recording layer corresponding to the image to be recorded; and (III) heating the recording layer substantially uniformly at a temperature and for a time sufficient to produce a developed image in the recording layer.

The step (I) of imagewise altering the conductivity of the photoconductive layer is preferably carried out while simultaneously (II) applying the described electrical potential across the photoconductive layer and recording layer. Prior to heating in (III) the recording layer is separated from the remainder of the recording element. Optionally, the heating in (III) is carried out while the recording layer is contiguous to the interlayer.

One example of the invention for producing an image, such as a dye image and silver image, especially a dye enhanced silver image, by an electrically activated recording process comprises the steps: (I) imagewise applying through the ECI layer an electrical potential, of a magnitude and for a time sufficient to produce in the image areas a charge density within the range of about $10^{-5}$ coulomb/cm$^2$ to about $10^{-8}$ coulomb/cm$^2$ to an electrically activatable recording layer of a recording element according to the invention, the charge density forming a developable latent image in the recording layer; and, then (II) heating the element substantially uniformly at a temperature and for a time sufficient to produce a developed image, preferably a dye image and silver image in the recording layer. In this process, means other than a photoconductor are useful to produce the desired image in the recording layer, such as a contact or non-contact electrode.

The heating step in each of the described examples is carried out at a temperature within the range of about 80° C. to about 200° C., typically at a temperature within the range of about 100° C. to about 180° C., until the desired silver image and dye image are formed.

DETAILED DESCRIPTION OF THE INVENTION

Figure 1:
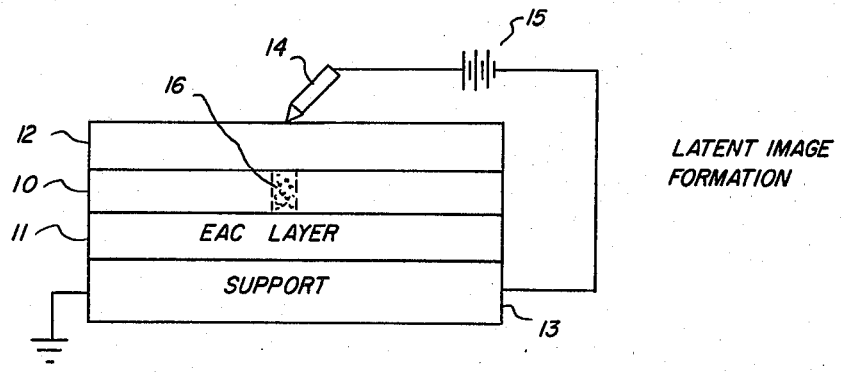
FIGS. 1 and 2 illustrate schematically a process and an image recording material according to one illustrative embodiment of the invention.

The term "electrically conductive interlayer" herein has been abbreviated as "ECI layer". This term describes a layer which is located contiguous to the electrically activatable recording layer (the layer in which a latent image is formed). During imaging the ECI layer is optionally contiguous to both the electrically activating recording layer and to a photoconductive layer. The ECI layer is defined as electrically conductive because electrical charge or electrical current is passed through the ECI layer and the image recording layer during imagewise exposure. The electrically conductive particles, such as carbon particles, in the ECI layer account for electrical conductivity of the ECI layer. The electrically insulating binder, such as a silicone rubber binder, in the ECI layer does not prevent the ECI layer from being sufficiently electrically conductive to enable desired imaging. The ohmic resistivity of the ECI layer is preferably within the range of about $10^2$ ohm-cm to about $10^{12}$ ohm-cm.

A variety of electrically conductive particles are useful in the ECI layer. Any particle is useful which has the desired resistivity and enables the desired imaging. The particles in the ECI layer preferably have an ohmic resistivity within the range of $10^6$ to $10^{12}$ ohm-cm. An ohmic resistivity within the range of $10^7$ to $10^{11}$ ohm-cm is particularly useful. The particles are preferably sufficiently finely divided to enable the desired degree of resolution and granularity. The average particle size is within the range of about 0.5 micron to about 15 microns. A preferred average particle size is within the range of 0.1 micron to 10 microns. Examples of useful particles are carbon, copper, nickel, silver, gold, indium, palladium, aluminum indium oxide and tin oxide particles. Carbon particles are preferred. Combinations of different kinds of particles, such as combinations of carbon particles with tin oxide particles, are also useful in the ECI layer.

The electrically conductive particles are useful in a range of concentrations in the ECI layer. A preferred concentration of electrically conductive particles is within the range of about 10% to about 80% by volume of ECI layer. A particularly useful concentration of carbon particles is within the range of 20% to 60% by volume of ECI layer. Selection of an optimum concentration and kind of electrically conductive particles in an ECI layer depends upon such factors as the particular particle, the desired image, the particular binder and imagewise exposure conditions.

A wide variety of electrically insulating binders are useful in an ECI layer. Any binder is useful that has the desired resistivity, is compatible with the electrically conductive particles, and enables the desired imaging upon imagewise exposure. The binder should be film forming. Optionally, the binder has properties, such as viscosity, which enable the ECI layer to be a self supporting layer. The binder for the ECI layer is hydrophobic or hydrophilic. Combinations of binders are useful, if desired. Hardness is also a criterion because this property indicates the degree which the binder will enable the ECI layer to effectively minimize the air gap between the photoconductor layer and the electrically activatable recording layer. The ECI layer having a proper hardness range is useful even though the surfaces of the photoconductor layer and electrically activatable recording layer are not completely smooth. Examples of binders which are useful herein include silicone rubbers, polyesters, hydrocarbon rubbers, vinyl polymers, polyolefins and polyurethanes having a suitable hardness. An example of a useful test for the hardness of binders for the ECI layer is ASTM D-2240. The hardness is preferably within the range, in such a test, of about 20 to about 70 shore "A". Silicone rubbers that satisfy this test are, for example, RTV 602 and RTV-630 (these are siloxanes and are trademarks of and available from the General Electric Company, U.S.A.), pliable polyesters, such as Vitel (this is a polyester polymer, such as described in U.S. Pat. No. 4,403,132 and is a trademark of the Goodyear Co., U.S.A.), hydrocarbon rubbers such as styrene co butadiene, rubbery vinyl polymers, such as poly(butylacrylate) and poly(methyl acrylate), polyolefins such as Epolene (a trademark of Eastman Kodak Co., U.S.A.) and polyurethanes such as Vithane (a trademark of the Goodyear Co., U.S.A.). An electrically insulative silicone rubber binder is preferred.

The electrically insulative binder is useful in a range of concentrations in an ECI layer. A preferred concentration of electrically insulative binder in an ECI layer is within the range of 20% to 90% by volume. An especially useful concentration of binder in the ECI layer is within the range of 40% to 80% by volume. Selection of an optimum concentration of binder in the ECI layer depends upon such factors as the particular binder, the desired image, the particular electrically conductive particle and imagewise exposure conditions. The binder and binder concentration should be sufficiently insulating to help enable the ECI layer to have an ohmic resistivity preferably within the range of about $10^2$ to about $10^{12}$ ohm-cm.

The ECI layer preferably comprises about 10 mg to about $10^5$ mg of electrically conductive finely divided particles per square meter of support. The finely divided particles are uniformly dispersed in insulating binder. The ECI layer preferably comprises about 10 mg to about $10^5$ mg of insulating binder per square meter of support.

The thickness of the ECI layer is preferably within the range of 0.5 micron to 500 microns. If the ECI layer is not self supporting, the thickness of the ECI layer is preferably within the range of 0.5 micron to 150 microns. If the ECI layer is a self supporting film, the thickness of the ECI layer is preferably within the range of 5 microns to 500 microns.

The ECI layer is preferably sufficiently pliable to minimize any air gap between the image recording layer and the ECI layer during formation of a latent image in the image recording layer. If the surface of the image recording layer is not entirely smooth, the pliability of the ECI layer enables the ECI layer to conform to the surface of the image recording layer to minimize any air gap at the interface between the ECI layer and the image recording layer and any air gap at the interface between the ECI layer and a photoconductive layer.

The exact mechanisms by which the latent image is formed in the recording layer and by which the ECI layer functions in an element according to the invention are not fully understood. It is postulated that the injection of a charge carrier due to an electric field through the ECI layer into the combination of components in the recording layer results in the formation of a developable latent image in the recording layer. The current in the image areas does not spread to non-image areas of the ECI layer. It is believed that development of the latent image formed in the recording layer is accomplished by a reaction in which the latent image catalyzes the reaction of the described image-forming combination. In a preferred development reaction in the recording layer, an organic silver salt oxidizing agent reacts with the reducing agent. The oxidized form of the reducing agent resulting from this reaction in turn reacts with a dye-forming coupler in the recording layer to produce a dye in the image areas. It is not entirely clear, however, what part, if any, the dye-forming coupler and the other described components play in latent image formation.

While many image recording compositions containing the described components are useful, the optimum image recording composition and image recording element depend upon such factors as the desired image, the particular image-forming material, the source of exposing energy and processing condition ranges.

The term "electrically activatable recording element" as used herein means an element which, when subjected to an electrical charge or electrical current, undergoes a chemical and/or electrical change which provides a developable latent image.

The term "latent image" as used herein means an image that is not visible to the unaided eye or is faintly visible to the unaided eye and that is capable of amplification in a subsequent processing step, especially in a subsequent heat development step.

The electrically activatable recording material as used herein preferably has an ohmic resistivity of at least about $10^4$ ohm-cm.

The term "electrically conductive" such as in "electrically conductive support" is intended herein to mean a support, layer or binder that has a resistivity less than about $10^{12}$ ohm-cm.

The term "electrically active conductive" as used herein has been abbreviated as "EAC". This term describes a layer which is located between the electrically activatable recording layer (the layer in which a latent image is formed) and the electrically conductive support of an element according to the invention. This EAC layer is defined as electrically active because a desired degree of increased sensitivity to the image recording layer is produced when electrical current is passed through the layers during imagewise exposure.

A wide variety of photoconductors are useful in an element according to the invention. Selection of an optimum photoconductor depends upon such factors as the particular electrically activatable recording layer, the charge sensitivity of the element, the desired image, the ohmic resistivity desired, exposure means and processing conditions. It is advantageous to select a photoconductor which has the property of being the most useful with the operative voltages to be used for imaging. The photoconductor is either an organic photoconductor or an inorganic photoconductor. Combinations of photoconductors are useful. The resistivity of the photoconductor changes rapidly in the operating voltage ranges that are useful. In some cases, it is desirable that the photoconductor layer have, what is known in the art as, persistent conductivity. Examples of useful photoconductors include lead oxide, cadmium sulfide, cadmium selenide, cadmium telluride and selenium. Useful organic photoconductors include, for instance, polyvinyl carbazole/trinitrofluorenone photoconductors and aggregate type organic photoconductors described in, for example, U.S. Pat. No. 3,615,414. These photoconductors are known in the image recording art and are described in, for example, U.S. Pat. No. 3,577,272; *Research Disclosure,* August 1973, Item 11210 of Reithel, published by Industrial Opportunities Ltd., Homewell, Havant, Hampshire, P09 1EF, UK; "Electrography" by R. M. Schaffert (1975) and "Xerography and Related Processes" by Dessauer and Clark (1965) both published by Focal Press Limited.

An especially useful photoconductor layer comprises a dispersion of a lead oxide photoconductor in an insulating binder, such as a binder comprising a polycarbonate (for example, LEXAN, a trademark of General Electric Company, U.S.A., consisting of a Bisphenol A polycarbonate), polystyrene or poly(vinyl butyral).

A recording element according to the invention is especially useful wherein the photoconductor layer is X-ray sensitive and the conductivity of the photoconductor layer is imagewise altered by imagewise exposing the photoconductor layer to X-ray radiation.

Many electrically activatable recording materials are useful in an image recording layer of an element according to the invention. Useful electrically activatable recording materials include, for instance, those described in U.K. Patent Specification No. 1,524,024; U.S. Pat. No. 3,978,335; U.S. Pat. No. 4,155,760; and U.S. Pat. No. 4,155,761. A useful image recording layer of an electrically activatable recording element according to the invention comprises an image-forming combination, such as an oxidation-reduction image-forming combination comprising (i) an organic metal salt oxidizing agent, such as an organic silver salt oxidizing agent, with (ii) a reducing agent for the organic metal salt oxidizing agent.

A wide variety of organic metal salt oxidizing agents are useful in an image recording layer according to the invention. Useful organic metal salt oxidizing agents include silver salts of organic acids, such as long chain fatty acids. Examples of useful organic metal salt oxidizing agents include silver behenate, silver stearate, silver oleate, silver laurate, silver hydroxystearate, silver caprate, silver myristate and silver palmitate. Combinations of organic metal salt oxidizing agents are useful in an image recording layer according to the invention. Other useful organic metal salt oxidizing agents are described in *Research Disclosure,* June 1978, Item No. 17029, the description of which is incorporated herein by reference.

The described organic silver salt oxidizing agent contains a range of ratios of the organic moiety to the silver ion. The optimum ratio of the organic moiety to silver ion in the organic silver salt oxidizing agent depends upon such factors as the particulr organic moiety, the particular concentration of silver ion desired, processing conditions, the particular dye-forming coupler and the like. The molar ratio of organic moiety to silver as silver ion in the salt is generally within the range of about 0.5:1 to about 3:1.

An especially useful electrically activatable recording layer comprises (A) a dye-forming coupler, (B) an oxidation-reduction image-forming combination comprising (I) an organic silver salt oxidizing agent, especially an organic silver salt oxidizing agent consisting essentially of a silver salt of a 1,2,4-mercaptotriazole derivative, with (II) a reducing agent, which in its oxidized form forms a dye with the dye-forming coupler. Such an electrically activatable recording layer enables formation of a dye image and a silver image, preferably a dye enhanced silver image.

Many dye-forming couplers are useful in the element and process according to the invention. The exact mechanism by which the dye image and silver image are produced is not fully understood. However, it is believed that the dye-forming coupler reacts with the oxidized form of the reducing agent to form a dye. The term dye-forming coupler herein means a compound or combination of compounds which, with other of the components, produces a desired dye image upon processing the recording layer after exposure. These are designated as dye-forming couplers because it is believed that the compounds couple with oxidized developer to produce a dye. The dye-forming couplers described herein are also known in the photographic art as color-forming couplers. Selection of a suitable dye-forming coupler is influenced by such factors as the desired dye image, other components of the recording layer, processing conditions and particular reducing agent in the recording layer. An example of a useful magenta dye-forming coupler is 1-(2,4,6-tri-chlorophenol)-3-[3-]α-(3-pentadecylphenoxy)-butyramido [benzamido]-5-pyrazolone. A useful cyan dye-forming coupler is 2,4-dichloro-1-naphthol. A useful yellow dye-forming coupler is α-[3-{α-(2,4-di-tertiary-amylphenoxy)acet-amido}-benzoyl]-2-fluoroacetanilide. Examples of useful cyan, magenta and yellow dye-forming couplers are selected from those described in, for example, "Neblette's Handbook of Photography and Reprography", edited by John M. Sturge, 7th Edition, 1977, pages 120–121 and *Research Disclosure,* December 1978, Item 17643, Paragraphs VII C-G.

An especially useful dye-forming coupler is a resorcinol dye-forming coupler. The resorcinol dye-forming coupler is preferably one that produces a neutral (black) or nearly neutral appearing dye with the oxidized form of the described reducing agent. Monosubstituted resorcinol dye-forming couplers containing a substituent in the two position are especially useful. The resorcinol dye-forming coupler and other components in the recording layer should be sufficiently stable to avoid any significant adverse interaction in the recording layer prior to imagewise exposure and processing. Many resorcinol dye-forming couplers are useful. A useful resorcinol dye-forming coupler is one represented by the formula:

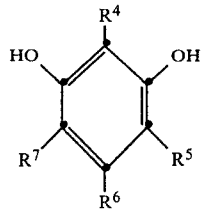

wherein $R^4$ is hydrogen, $$\overset{O}{\overset{\|}{C}}OH,\ NHC\overset{O}{\overset{\|}{R^8}},\ C\overset{O}{\overset{\|}{R^9}},\ \text{or}\ NHSO_2R^{10};$$

$R^5$ is hydrogen, $$\overset{O}{\overset{\|}{C}}OH,\ C\overset{O}{\overset{\|}{N}}HCH_2CH_2OH,\ \text{or}\ C\overset{O}{\overset{\|}{N}}H\text{-}C_6H_5\text{-}OC_5H_{11}n;$$

$R^6$ is hydrogen, $$NHC\overset{O}{\overset{\|}{R^8}},\ \text{or}\ C\overset{O}{\overset{\|}{R^9}};$$

$R^7$ is hydrogen, $$\overset{O}{\overset{\|}{C}}OH,\ C\overset{O}{\overset{\|}{N}}HCH_2CH_2OH,\ \text{or}\ C\overset{O}{\overset{\|}{N}}H\text{-}C_6H_5\text{-}C_5H_{11}n\ ;$$

$R^8$ is haloalkyl containing 1 to 3 carbon atoms, such as $CCl_3$, $CF_3$ and $C_3H_4Br_3$, $CH_2OCH_3$, $CH_2SR^{10}$, $NHR^{11}$, $C_2H_4COOH$, $CH{=}CH_2$, $NHC_2H_4Cl$, alkyl containing 1 to 20 carbon atoms, such as 1 to 10 carbon atoms, including methyl, ethyl, propyl and decyl, or phenyl;

$R^9$ is OH, $NH_2$, $NHCH_2CH_2OH$ and $NH(C_6H_5)OC_5H_{11}n$;

$R^{10}$ is alkyl containing 1 to 5 carbon atoms, such as methyl, ethyl, propyl or pentyl, or phenyl; and $R^{11}$ is hydrogen, haloalkyl containing 1 to 3 carbon atoms, such as $CCl_3$, $CF_3$ and $C_3H_4Br$, $CH_2OCH_3$, or $C_2H_4COOH$.

The letter n, such as in:

$$C\overset{O}{\overset{\|}{N}}H\text{-}C_6H_5\text{-}OC_5H_{11}n,$$

designates a linear group. Alkyl and phenyl, as described, include alkyl and phenyl that are unsubstituted alkyl and phenyl, as well as alkyl and phenyl that contain substituent groups that do not adversely effect the desired image. An example of a suitable substituent group is alkyl containing 1 to 3 carbon atoms, such as methyl or ethyl.

Examples of useful resorcinol dye-forming couplers are described in, for example, *Research Disclosure,* September 1978, Item 17326. Especially useful resorcinol dye-forming couplers include 2′,6′-dihydroxyacetanilide and 2′,6′-dihydroxytrifluoroacetanilide. Another useful resorcinol dye-forming coupler is 2′,6′-dihydroxy-2,5-dimethylbenzanilide (2′,6′-dihydroxyacetanilide has also been known as 2,6-dihydroxyacetanilide and 2′,6′-di-hydroxy-2,5-dimethylbenzanilide has also been known as 2,6-dihydroxy-2′,5′-dimethylbenzanilide).

Resorcinol dye-forming couplers as described are prepared by procedures known in the chemical art. For example, resorcinol couplers as described are prepared from amino resorcinols or dihydroxybenzoic acids.

The dye-forming coupler is useful in a range of concentrations in the described recording layer. For example, the recording layer preferably contains a concentration of dye-forming coupler that is within the range of about 0.1 to about 1.0 mole of the dye-forming coupler per mole of total silver in the recording layer. An especially useful concentration of dye-forming coupler is within the range of about 0.25 to about 0.75 mole of dye-forming coupler per mole of total silver in the recording layer.

Selection of an optimum concentration of dye-forming coupler depends upon such factors as the particular coupler, the desired image, processing conditions and other components in the recording layer.

Preferred silver salts of 1,2,4-mercaptotriazole derivatives include those represented by the formula:

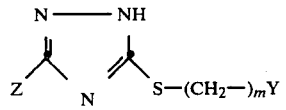

wherein Y is aryl containing 6 to 12 carbon atoms, such as phenyl, naphthyl and para-chlorophenyl; m is 0, 1 or 2; and Z is hydrogen, hydroxyl or amine (—$NH_2$). Especially useful organic silver salt oxidizing agents within this class are those silver salts of the described 1,2,4-mercaptotriazole derivatives wherein Y is phenyl, naphthyl or parachlorophenyl and Z is amine (—$NH_2$). An example of such a compound is the silver salt of 3-amino-5-benzylthio-1,2,4-triazole (referred to herein as ABT). Such organic silver salt oxidizing agents are described in, for instance, U.S. Pat. No. 4,123,274 and U.S. Pat. No. 4,128,557.

Combinations of organic silver salt oxidizing agents are useful. An example of a combination of organic silver salt oxidizing agents is the combination of the silver salts of ABT with the silver salt of 1-methyl-4-imidazoline-2-thione. Other combinations include the combination of the silver salt of ABT with silver salts of nitrogen acids described in *Research Disclosure,* Volume 150, October 1976, Item 15026.

Selection of an optimum organic silver salt oxidizing agent or combination of organic silver salt oxidizing agents depends upon the described factors, such as the desired image, the particular reducing agent, the particular dye-forming coupler, processing conditions and the particular binder. A preferred organic silver salt oxidizing agent is the silver salt of ABT.

The organic silver salt oxidizing agent or combination of organic silver salt oxidizing agents are useful in a range of concentrations in the described recording layer. Selection of an optimum concentration of organic silver salt oxidizing agent or combination of organic silver salt oxidizing agents depends upon the described factors, such as the desired image, the particular reducing agent, the particular dye-forming coupler, the particular binder, and processing conditions. A preferred concentration of organic silver salt oxidizing agent or combination of organic silver salt oxidizing agents is within the range of about 0.1 mole to about 2.0 moles of silver salt oxidizing agent per mole of reducing agent in the recording layer. For example, when the organic silver salt oxidizing agent is the silver salt of ABT, an example of a useful concentration of the organic silver salt oxidizing agent is within the range of about 0.1 to about 2.0 moles of organic silver salt oxidizing agent per mole of reducing agent in the recording layer.

Preparation of the described organic silver salt oxidizing agent is generally not carried out in situ, that is, not in combination with other components of the recording layer as described. Rather, the preparation of the oxidizing agent is generally carried out ex situ, that is separate from other components of the recording layer. In most instances, the preparation of the organic silver salt oxidizing agent is separate from the other components based on the ease of control of preparation and storage capability.

The term "salt" as used herein, such as in organic silver salt, is intended to include any type of bonding or complexing mechanism which enables the resulting material to produce desired imaging properties in the described recording layer. In some instances, the exact bonding of the described silver salt with the organic compound is not fully understood. Accordingly, the term "salt" is intended to include what are known in the chemical art as "complexes". The term "salt" is intended to include, for example, neutral complexes and nonneutral complexes. The term is also intended to include compounds which contain any form of bonding which enables the desired image-forming combination to provide the desired image.

The term "reducing agent" as used herein includes compounds which are reducing agent precursors in the described recording layer. That is, those compounds are included which are not reducing agents in the recording layer until a condition occurs such as heating of the recording layer.

A wide variety of reducing agents are useful in the electrically activatable recording layer. Combinations of reducing agents are also useful. Examples of useful reducing agents, include phenolic reducing agents, which are those known to be useful in an oxidation-reduction imaging combination in the photothermographic art. These are described in *Research Disclosure,* June 1978, Item No. 17029.

Many reducing agents which, in their oxidized form, form a dye with the described dye-forming coupler are useful in the recording element according to the invention. The reducing agent generally is an organic silver halide color developing agent. Combinations of such reducing agents are useful. It is important that the reducing agent produce an oxidized form upon reaction with the organic silver salt oxidizing agent which reacts at processing temperature with the described dye-forming coupler to produce a desired dye. Especially useful reducing agents are primary aromatic amines including, for example, paraphenylenediamines. Examples of useful reducing agents which are primary aromatic amines include 4-amino-N,N-dimethylaniline; 4-amino-N,N-diethyl-aniline; 4-amino-3-methyl-N,N-diethylaniline (also known as N,N-diethyl-3-methyl-paraphenylenediamine); 4-amino-N-ethyl-N-β-hydroxyethylaniline; 4-amino-3-methyl-N-ethyl-N-β-hydroxyethylaniline; 4-amino-3-methoxy-N-ethyl-N-β-hydroxyethylaniline; 4-amino-N-butyl-N-gammasulfobutylaniline; 4-amino-3-methyl-N-ethyl-N-β-sulfoethylaniline; 4-amino-3-β-(methanesulfonamido)ethyl-N,N-diethylaniline; 4-amino-3-methyl-N-ethyl-N-β-(methanesulfonamido)ethylaniline; and 4-amino-3-methyl-N-ethyl-N-β-methoxyethylaniline.

An especially useful reducing agent is one that consists essentially of a paraphenylenediamine silver halide developing agent that exhibits an E ½ value in aqueous solution at pH 10 within the range of −25 to +175 millivolts versus SCE. The term "E ½ value" herein means half wave potential. The term "SCE" herein means saturated calomel electrode. These values are determined by analytical procedures known in the photographic art and described in, for example, the text "The Theory of the Photographic Process", 4th Edition, Mees and James, 1977, pages 318–319.

The described reducing agent is useful in a range of concentrations in the described element according to the invention. Selection of an optimum concentration of reducing agent or combination of reducing agents depends upon the described factors including the desired image, the particular organic silver salt oxidizing agent, the particular dye-forming coupler and processing conditions. A preferred concentration of reducing agent or combination of reducing agents is within the range of about 0.1 to about 5.0 moles of reducing agent per mole of organic silver salt in the recording layer as described. An especially useful concentration of reducing agent is within the range of about 0.2 to about 2 moles of reducing agent per mole of organic silver salt in the recording layer.

The tone of the combined silver image and dye image produced according to the invention varies, depending upon such factors, as the silver morphology of the developed silver image, the covering power of the silver materials, the particular dye-forming coupler, the particular developing agent, processing conditions and the like. In recording layers that produce a brown silver image, the hue of the dye image produced is preferably complimentary to the hue of the silver image. An image hue of the combined dye image and silver image is preferably "neutral".

The term "neutral" herein includes hues which occasionally are described in the photographic art as blue-black, gray, purple-black, black and the like. Whether or not a given image is "neutral" can be readily determined by visual inspection with the unaided eye.

Procedures for determining whether or not an image is "neutral" are known in the photographic art, such as described in *Research Disclosure,* September 1978, Item 17326.

The described element according to the invention comprises various colloids and polymers alone or in combination as vehicles and binding agents. These vehicles and binding agents are in various layers of the element, especially in the recording layer. Suitable materials are hydrophobic or hydrophilic. It is necessary, however, that the vehicle or binder in the element not adversely affect the charge sensitivity or ohmic resistivity of the element of the invention. Accordingly, the selection of an optimum colloid or polymer, or combination of colloids or polymers, depends upon such factors as the desired charge sensitivity, desired ohmic resistivity, particular polymer, desired image, particular processing conditions, and particular EAC layer. Preferred colloids and polymers are transparent or translucent and include both naturally occurring substances such as proteins, for example, gelatin, gelatin derivatives, cellulose derivatives, polysaccharides, such as dextran, gum arabic and the like. Synthetic polymers, however, are preferred due to their desired charge sensitivity properties and ohmic resistivity properties. Useful polymeric materials for this purpose include polyvinyl compounds, such as poly(vinyl pyrrolidone), acrylamide polymers and dispersed vinyl compounds such as in latex form. Effective polymers include water insoluble polymers of alkylacrylates and methacrylates containing minor amounts of acrylic acid, sulfoalkylacrylates or methacrylates and those which have cross-linking sites which facilitate hardening or curing. Especially useful polymers are high molecular weight materials and resins which are compatible with the described components of the element according to the invention. These include, for example, poly(vinyl butyral), cellulose acetate butyrate, poly(methyl methacrylate), poly(vinyl pyrrolidone), ethyl cellulose, polystyrene, poly(vinyl chloride), poly(isobutylene), butadienestyrene copolymers, vinyl chloride-vinyl acetate copolymers, copolymers of vinyl acetate, vinyl chloride and maleic acid and poly(vinyl alcohol). Combinations of colloids and polymers are also useful depending upon the described factors. Highly preferred binders include polyacrylamide, and copolymers of acrylamide and other vinyl addition monomers such as copolymers of acrylamide and vinyl imidazole or copolymers of acrylamide and N-methyl acrylamide.

An overcoat layer is useful on the recording layer. If an overcoat layer is used, it is important that the overcoat layer not adversely affect the desired charge sensitivity and ohmic resistivity properties of the element according to the invention. Such an overcoat layer reduces fingerprinting and abrasion marks before and after exposure and processing. The overcoat layer is one or more of the described polymers which are useful as binders. These materials must be compatible with other components of the described element according to the invention and must be able to tolerate the processing temperatures which are useful for developing the described images.

While it is in most cases unnecessary and undesirable, a photosensitive component is optionally present in the electrically activated recording layer. The photosensitive component is any photosensitive metal salt or complex which produces developable nuclei upon charge exposure according to the invention. If a photosensitive component is present in the recording layer, an especially useful photosensitive metal salt is photosensitive silver halide due to its desired properties in forming developable nuclei upon charge exposure. A useful concentration of photosensitive metal salt is within the range of about 0.0001 to about 10.0 moles of photosensitive metal salt per mole of organic silver salt in the described element. For example, a preferred concentration range of photosensitive silver halide is within the range of about 0.001 to about 2.0 moles of silver halide per mole of organic silver salt in the recording element. Preferred photosensitive silver halides are silver chloride, silver bromide, silver bromoiodide and mixtures thereof. For purposes of the invention, silver iodide is also considered to be a photosensitive silver halide.

Very fine grain photographic silver halide is useful, although a range of grain size from fine grain to coarse grain photographic silver halide is included in the recording layer, if desired. The photographic silver halide is prepared by any of the procedures known in the photographic art. Such procedures and forms of photographic silver halide are described in, for example, *Research Disclosure,* December 1978, Item No. 17643. The photographic silver halide, if desired, is washed or unwashed, is chemically sensitized by means of chemical sensitization procedures known in the art, is protected against the production of fog and stabilized against loss of sensitivity during keeping, as described in the *Research Disclosure* publication.

If a photosensitive component is present in the described electrically activated recording layer, the described image-forming combination enables the concentration of the photosensitive component to be lower than ordinarily would be expected in a photosensitive element. This lower concentration is enabled by the amplification affect of the image-forming combination, as described, as well as the formation of developable nuclei according to the invention in addition to the dye enhancement of the silver image formed. In some instances the concentration of photosensitive metal salt is sufficiently low that after imagewise exposure and development of the photosensitive metal salt alone, in the absence of other of the described components, the developed image is not visible to the unaided eye.

The elements according to the invention contain, if desired, addenda which aid in producing a desired image. These addenda include, for example, development modifiers that function as speed-increasing compounds, hardeners, plasticizers and lubricants, coating aids, brighteners, spectral sensitizing dyes, absorbing and filter dyes. These addenda are described in, for example, *Research Disclosure,* December 1978, Item 17643.

While it is in many cases unnecessary and undesirable, a post-processing stabilizer or stabilizer precursor to increase post-processing stability of the developed image is included in the described recording layer. In many cases the recording layer following processing is sufficiently stable to avoid the need for incorporation of a stabilizer or stabilizer precursor in the recording layer. In the case of recording materials which contain photosensitive silver halide, it is desirable to include such a stabilizer or post-processing stabilizer precursor to provide increased post-processing stability. Many stabilizer or stabilizer precursors are useful in the elements according to the invention. These stabilizers or stabilizer precursors are useful alone or in combination, if desired. Examples of useful stabilizers or stabilizer precursors include photolytically active polybrominated organic compounds. Thioethers or blocked azolinethione stabilizer precursors or other organic thione stabilizer precursors known to be useful in photothermographic materials are useful, if desired.

When a stabilizer or stabilizer precursor is present in the recording layer of an element according to the invention, a range of concentrations of stabilizer or stabilizer precursor is useful. The optimum concentration of stabilizer or stabilizer precursor depends upon such factors as the particular element, processing conditions, particular stabilizer or stabilizer precursor, desired stability of the developed image. A useful concentration of stabilizer or stabilizer precursor is within the range of about 1 to about 10 moles of stabilizer or stabilizer precursor per mole of photosensitive component in the element according to the invention.

It is often advantageous to include a heat sensitive base-release agent or base precursor in the recording element to produce improved and more effective image development. A base-release agent or base precursor herein includes compounds, which upon heating in the recording layer, produce a more effective reaction between the described components of the image-forming combination and in addition produce improved reaction between the oxidized form of the described reducing agent and the dye-forming coupler. Examples of useful heat sensitive base-release agents or base precursors are aminimide base-release agents, such as described in *Research Disclosure,* Volume 157, May 1977, Items 15733, 15732, 15776 and 15734; guanidinium compounds, such as guanidinium trichloroacetate; and other compounds which are known in the photothermographic art to release a base moiety upon heating, but do not adversely affect the desired properties of the recording element. Combinations of heat sensitive base-release agents are useful, if desired.

A heat sensitive base-release agent or base precursor, or combinations of such compounds, is useful in a range of concentrations in the described elements according to the invention. The optimum concentration of heat sensitive base-release agent or base precursor depends upon such factors as the desired image, particular dye-forming coupler, particular reducing agent, other components of the imaging element, processing conditions and the like. A preferred concentration of described base-release agent is within the range of about 0.25 to 2.5 moles of base-release agent or base precursor per mole of reducing agent in the recording layer according to the invention.

The electrically activatable recording element according to the invention advantageously comprises a variety of supports. The term "electrically conductive support" herein includes (a) supports that are electrically conductive without the need for separate addenda in the support or on the support to produce the desired degree of electrical conductivity and (b) supports that comprise addenda or separate electrically conductive layers that enable the desired degree of electrical conductivity. Typical supports include cellulose ester, poly(vinyl acetal), poly(ethylene terephthalate), polycarbonate and polyester film supports and related films and resinous materials. Other supports are useful, such as glass, paper, metal and the like which can withstand the processing temperatures described and do not adversely affect the charge-sensitive properties and ohmic resistivity which is desired. A flexible support is most useful. It is necessary that the various layers according to the invention adhere to the support. A subbing layer to aid adhesion is preferred on the support. Such a subbing layer is, for example, a poly(methyl acrylate-co-vinylidene chloride-co-itaconic acid) subbing layer.

The recording element according to the invention generally includes an electrically conductive layer positioned between the support and the image recording layer. Alternatively, the recording element includes an electrically conductive layer positioned between the support and the described polymeric EAC layer. This is illustrated by electrically conductive layer 55 in FIG. 5. The electrically conductive layers, as described, such as layers 60 and 55 in FIG. 5, comprise a variety of electrically conducting compounds which do not adversely effect the charge sensitivity and ohmic resistivity properties of an element according to the invention. Examples of useful electrically conductive layers include layers comprising nickel or an electrically conductive chromium composition, such as cermet.

Figure 5:
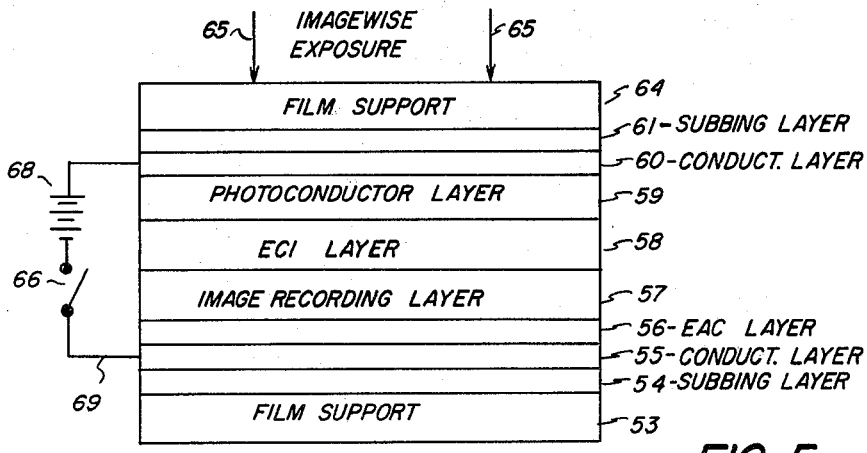
FIG. 5 illustrates schematically an image recording material that is particularly useful according to the invention.

In some embodiments, the photoconductor layer is a self-supporting layer, such as a photoconductor in a suitable binder. In such embodiments an electrically conductive layer, such as an electrically conductive nickel or chromium composition layer, is coated on the photoconductive layer. This is illustrated in, for instance, FIG. 3 in the drawings in which electrically conductive layer 28 is positioned over photoconductive layer 30 which is self-supporting. Optionally, the photoconductive layer is coated on an electrically conductive support, such as illustrated in FIG. 5 of the drawings.

The described layers according to the invention are coated by coating procedures known in the photographic art, including vacuum deposition, sintering, dip coating, airknife coating, curtain coating or extrusion coating, using hoppers known in the photographic art. If desired, two or more layers are coated simultaneously.

The various components of the charge-sensitive materials according to the invention are prepared for coating by mixing the components with suitable solutions or mixtures including suitable organic solvents depending on the particular charge-sensitive material and the components. The components are added by means of procedures known in the photographic art.

Useful electrically activatable recording elements according to the invention comprise an electrically conductive support having thereon an image recording layer which has a thickness within the range of about 1 to about 30 microns, typically within the range of about 2 to about 15 microns. The optimum layer thickness of each of the layers of an element according to the invention depends upon such factors as the particular ohmic resistivity desired, charge sensitivity, particular components of the layers, desired image and the like.

An EAC layer, such as layer 56 illustrated in FIG. 5, preferably has a thickness within the range of about 0.02 to about 10 microns, such as within the range of about 0.05 to about 5 microns. The optimum layer thickness of the EAC layer depends upon such factors as the particular ohmic resistivity desired, charge sensitivity, desired image and the electrically activated recording layer.

A "melt-forming compound" is useful in the recording layer according to the invention to produce an improved developed image. A "melt-forming compound" is especially useful with recording materials containing silver salts of nitrogen acids. The term "melt-forming compound" herein is intended to mean a compound which, upon heating to the described processing temperature, produces an improved reaction medium, typically a molten medium, wherein the described image-forming combination produces a desired image upon development. The exact nature of the reaction medium at the processing temperatures described is not fully understood. It is believed that at the reaction temperature, a melt occurs which permits the reaction components to better interact. If desired, a melt-forming compound is included with other components of the recording layer prior to coating on the support. Examples of useful melt-forming compounds include succinimide, dimethyl urea, sulfamide and acetamide.

The optimum concentration of the described components of the element according to the invention depends upon a variety of factors. A preferred recording element according to the invention comprises about 1 to about 5 moles of the dye-forming coupler for each 1 to 5 moles of the reducing agent and about 3 to about 20 moles of the organic silver salt oxidizing agent.

The image recording layer of the invention has a range of pAg. The pAg is measured by means of conventional calomel and silver-silver chloride electrodes, connected to a commercial digital pH meter. The pAg in a dispersion containing the described components for the recording layer is advantageously within the range of about 2.5 to about 7.5. The optimum pAg depends upon the described factors, such as the desired image, processing conditions and the like.

A recording material containing the described organic silver salt oxidizing agent generally has a pH that is within the range of about 1.5 to about 7.0. An especially useful pH for the described recording layer is within the range of about 2.0 to about 6.0.

The desired resistivity characteristics of a recording material according to the invention are determined by separately measuring the current-voltage characteristic of each sample coating at room temperature by means of a mercury contact sample holder to make a mercury contact to the surface of the coating. To eliminate the possibility that a micro thickness surface air gap might affect the measured resistivity, exposures are made with an evaporated metal electrode, such as a bismuth or aluminum electrode, on the surface of a charge sensitive coating to be tested. The resistivity is measured at various ambient temperatures. The data are measured at a voltage of, for example, 20 volts or $4\times10^4$ volts per centimeter, which is within the ohmic response range of the layer to be tested. The resistivity of the charge-sensitive layer varies widely with temperature. The dielectric strength of the layer also varies with temperature.

A preferred embodiment of the invention having the desired characteristics comprises an electrically activatable recording element, preferably having an ohmic resistivity of at least about $10^4$ ohm-cm, comprising, in sequence: (a) a first electrical conducting layer, (b) a photoconductive layer, (c) an electrically activatable recording layer comprising, in reactive association: (A) a dye-forming coupler consisting essentially of 2′,6′-dihydroxytrifluoroacetanilide, (B) an image-forming combination consisting essentially of (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethylaniline sulfate, and (C) a polyacrylamide binder, (d) an EAC layer, such as an EAC layer consisting essentially of a poly(alkyl acrylate-co-vinylidene chloride), on (e) a second electrical conducting layer, which is on (f) a support wherein recording layer (c) and photoconductor layer (b) are separated by a separable, self supporting, electrically conductive pliable film comprising electrically conductive, finely divided carbon particles uniformly dispersed in electrically insulating silicone rubber.

A variety of energy sources are useful for imagewise exposure of a recording element according to the invention. Selection of an optimum energy source for imagewise exposure depends upon the described factors, such as the sensitivity of the photoconductor layer, the particular image recording combination in the electrically activatable recording layer, desired image and the like. Useful energy sources for imagewise exposure include, for example, visible light, X-rays, lasers, electron beams, ultraviolet radiation, infrared radiation and gamma rays.

An embodiment according to the invention which produces a dye image and silver image comprises (I) imagewise altering the conductivity of the photoconductive layer of the electrically activatable recording element according to the invention in accord with an image to be recorded; (II) applying across the photoconductive layer and recording layer through the ECI layer an electrical potential of a magnitude and for a time sufficient to produce a developable latent image in the recording layer corresponding to the image to be recorded; and (III) heating the recording layer substantially uniformly at a temperature and for a time sufficient to produce a dye image and a silver image, preferably a dye enhanced silver image, in the recording layer. The step (I) of imagewise altering the conductivity of the photoconductive layer is preferably carried out while simultaneously (II) applying the described electrical potential across the photoconductive layer and recording layer through the ECI layer.

A further process according to the invention is a dry, electrically activated recording process, preferably a process for producing a dye image and silver image, such as a dye enhanced silver image, in an electrically activatable recording element having an ECI layer according to the invention, comprising the steps: (I) imagewise altering the conductivity of a photoconductive layer in accord with an image to be recorded; (II) positioning the imagewise altered photoconductive layer from (I) in face-to-face relationship with an ECI layer on an electrically activatable recording layer of the recording element; (III) applying across the photoconductive layer and recording layer an electrical potential of a magnitude and for a time sufficient to produce in the areas of the recording layer corresponding to the imagewise altered portions of the photoconductive layer a charge density within the range of about $10-5$ coulomb/cm$^2$ to about $10^{-8}$ coulomb/cm$^2$, the charge density forming in the image areas a developable latent image; and (IV) uniformly heating the recording element at a temperature and for a time sufficient to produce a desired developed image, such as a dye image and silver image, especially a dye enhanced silver image, in the recording element.

Another embodiment according to the invention is a dry electrically activated recording process for producing a dye image and silver image, preferably a dye enhanced silver image, in an electrically activatable recording element having therein an ECI layer, said element containing at least one electrically activatable recording material comprising in an electrically conductive binder, (A) a dye-forming coupler, and (B) an image-forming combination. The image-forming combination comprises (i) an organic silver salt oxidizing agent consisting essentially of a silver salt of a 1,2,4-mercaptotriazole derivative, with (ii) a reducing agent which, in its oxidized form, forms a dye with the dye-forming coupler. The process comprises the steps: (I) positioning the recording material on an electrically conductive backing member; (II) modulating a corona ion current flow to the recording element by an electrostatic field, established imagewise between an image grid comprising an electroconductive core sequentially connectable to sources of different potential relative to the backing member and covered with a coating of a photoconductive insulating material and a control grid that is electrically conductive and sequentially connectable to sources of different potential relative to the backing member. The current flow is of a magnitude sufficient to produce a charge density within the range of about $10^{-5}$ to about $10^{-8}$ coulomb/cm$^2$ imagewise in said recording element, which charge density forms a developable latent image in the electrically activated recording material. The third step comprises substantially uniformly heating the recording element at a temperature and for a time sufficient to produce a dye enhanced silver image in the recording element.

An especially useful example of the invention is a dry electrically activated recording process for producing a dye enhanced silver image in a charge-sensitive recording element, preferably having an ohmic resistivity of at least about $10^4$ ohm-cm, comprising, in sequence, a support having thereon (a) a first electrically conductive layer, (b) an organic photoconductive layer, (c) an electrically activatable recording layer separated from (b) by an an ECI layer comprising carbon particles dispersed in a silicone rubber electrically insulating binder, and wherein layer (c) comprises (A) a dye-forming coupler consisting essentially of a compound selected from the group consisting of 2,6-dihydroxyacetanilide and 2′,6′-dihydroxytrifluoroacetanilide and combinations thereof, (B) an image-forming combination comprising (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethylanilinesulfate, and (iii) a polyacrylamide binder, (d) a polymeric EAC layer and (e) a second electrically conductive layer; said process comprising the steps: (I) imagewise altering the conductivity of the photoconductor layer in accord with an image to be recorded while simultaneously (II) applying across the photoconductive layer and recording layer an electrical potential of a magnitude and for a sufficient time to produce a developable latent image in the recording layer corresponding to the image; and (III) heating the recording layer substantially uniformly at a temperature and for a time sufficient to produce a dye enhanced silver image corresponding to the image in the recording layer.

An imagewise current flow is produced through the described electrically activated recording layer in step II above. Although a particular technique to produce an imagewise current flow has been described for use in a variety of recording apparatus, the especially useful techniques are those which include use of a photoconductor layer as an image to current converter. If desired, the imagewise current flow is provided by contacting the ECI layer on the recording element with a suitable electrostatically charged means such as an electrostatically charged stencil or scanning the ECI layer on the recording element with a beam of electrons.

Processing the recording element after latent image formation to form a developed image is carried out by means known in the photographic art. For example, the latent image is developed by physical development in a processing solution. Alternatively, the latent image is developed by chemical development in a processing solution. The processing solution contains processing compounds, such as developing agents and development activators that enable development of the latent image. Alternatively, the recording element after latent image formation is processed by merely uniformly heating the recording element containing an oxidation-reduction image-forming combination.

Heating the recording element, after latent image formation, is carried out by techniques and by means known in the photothermographic art. For example, the heating is carried out by passing the imagewise exposed recording element over a heated platen or through heated rolls, by heating the element by means of microwaves, by means of dielectric heating or by means of heated air. A visible image is produced in the described exposed material within a short time, that is within about 1 to about 90 seconds, by the described uniform heating step. An image having a maximum transmission density of at least 1.0 and preferably at least 2.2 is produced according to the invention. For example, the recording element is uniformly heated to a temperature within the range of about 100° C. to about 200° C. until a desired image is developed, such as within about 1 to about 90 seconds. The imagewise exposed material according to the invention is preferably heated to a temperature within the range of about 120° C. to about 180° C. The optimum temperature and time for processing depends upon such factors as the desired image, the particular recording element and heating means.

The described electrically activated recording process is useful for producing multiple copies. According to this example of the invention, multiple copies are prepared by a dry electrically activated recording process for producing an image, preferably a dye enhanced silver image, in an electrically activatable recording element comprising the steps of: (I) imagewise altering the conductivity of a photoconductive layer in accord with an image that is to be recorded; (II) positioning the imagewise altered photoconductive layer from (I) in face-to-face relationship on an ECI layer on an electrically activatable recording layer of the recording element, (III) applying an electrical potential across the photoconductive layer, the ECI layer and recording layer of a magnitude and for a time sufficient to produce a latent image in the areas of the recording layer corresponding to the imagewise altered portions of the photoconductive layer; (IV) uniformly heating the recording element at a temperature and for a time sufficient to produce a developed image, preferably a dye enhanced silver image, in the recording element; followed by (V) positioning the imagewise altered photoconductive layer in face-to-face relationship with an ECI layer on a second electrically activatable recording layer, (VI) applying an electrical potential across the photoconductor layer, the ECI layer and the second recording layer of a magnitude and for a sufficient time to produce a latent image in the areas of the recording layer corresponding to the imagewise altered portions of said photoconductive layer; and (VII) uniformly heating the second recording layer at a temperature and for a time sufficient to produce a developed image in the second recording layer.

While the exact mechanism of image formation upon heating is not fully understood, it is believed that the imagewise exposure provides nuclei in the image areas. Such nuclei are developable nuclei, either by chemical development or physical development. Alternatively, the nuclei apparently increase the reaction rate and act as catalysts for the reaction between the organic metal salt oxidizing agent and the reducing agent. It is believed that the nuclei enable a form of amplification which would not otherwise be possible. The organic metal salt oxidizing agent and reducing agent must be in a location with respect to each other which enables the nuclei formed to provide the desired catalytic effect. In those recording layers containing a dye-forming coupler, the organic metal salt oxidizing agent and reducing agent as well as the dye-forming coupler are in reactive association. The term "in reactive association" is intended to mean that the nuclei resulting from the imagewise exposure are in a location with respect to the described components which enables desired catalytic activity, desired processing temperature and capability for a more useful dye image and silver image.

Figure 2:
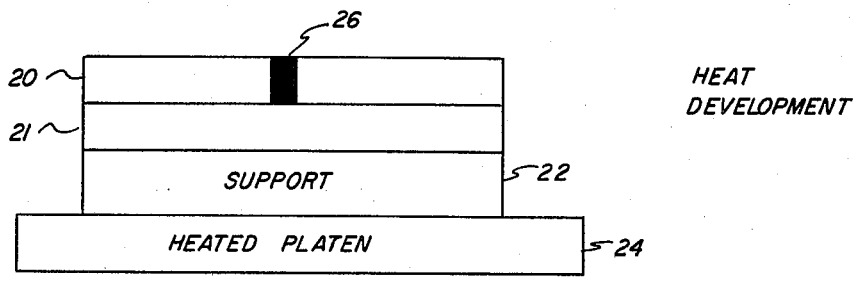

Referring to the drawings, embodiments of the invention are depicted schematically in FIGS. 1 and 2. According to the embodiment illustrated in FIGS. 1 and 2, a charge-sensitive recording layer 10 having a polymeric EAC layer 11 and an ECI layer 12 according to the invention is placed upon a grounded electrically conductive support 13. A current is selectively applied to the recording layer 10 through the ECI layer 12 by the point of a metal stylus 14 which is raised to a sufficiently high voltage relative to the support 13 by a voltage source 15, and brought into moving contact with the exposed surface of the ECI layer 12 containing carbon particles dispersed in a silicone rubber electrically insulative binder. Upon contacting the ECI layer 12 with the stylus 14, a current flow is produced in the areas, such as area 16, of the recording layer and a developable latent image forms, i.e. a pattern of nuclei sites, in the pattern desired. The charge density produced by the stylus in the contacted areas of the recording layer need not be sufficient to produce a visible image in the recording layer 10; however, the charge density in the image area of layer 10 must be sufficient to produce a latent image in the recording layer in those areas corresponding to those contacted by the stylus in layer 12. Although a particular technique to produce an imagewise current flow through the recording layer 10 has been described, techniques for producing imagewise current flow generally known in the art of recording may be used and are intended to be encompassed by the description. The area of the recording layer 10 designated as 16 is intended to be illustrative of an area of nuclei sites formed upon contact of the stylus 14 with the ECI layer 12. Other techniques for producing a nuclei pattern include, for example, contacting the ECI layer 12 with an electrostatically charged stencil or scanning the layer 12 with a beam of electrons in an image pattern.

FIG. 2 illustrates development of the latent image formed in the recording element in FIG. 1. The ECI layer 12 is removed from layer 10. The element from FIG. 1 is moved into contact with a heated metal platen 24. The heat from platen 24 passes through the support 22 and polymeric EAC layer 21 according to the invention to the layer 20 containing the latent image to cause the desired reaction in the latent image area. The reaction in the latent image area causes development to produce a visible image 26, such as a visible image consisting essentially of a dye image and silver image, preferably a dye enhanced silver image, in the recording layer 20. Upon development the recording element is removed from the platen 24. No processing solutions or baths are required in this heat development step.

Figure 3:
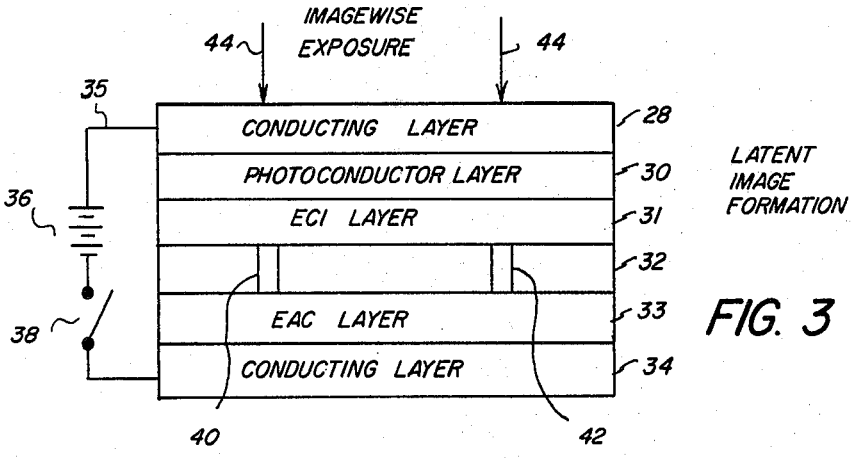
FIGS. 3 and 4 illustrate schematically an electrically activated recording process embodying the described invention.
Figure 4:
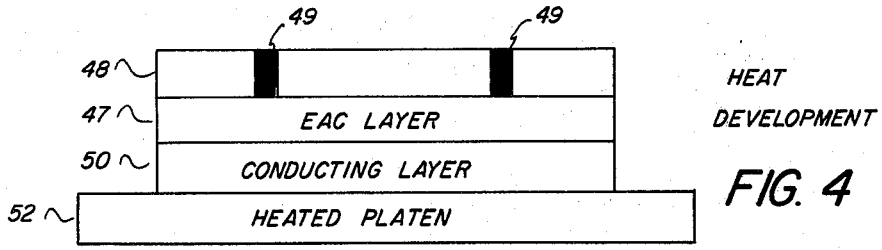

Another illustrative example of the invention is schematically shown in FIGS. 3 and 4. In this example, in FIG. 3, the developable sites 40 and 42, that is the latent image sites, are formed by sandwiching a charge-sensitive recording layer 32 and an image-to-current converter layer 30, preferably a photoconductor layer, between a pair of electrically conductive layers 28 and 34. A polymeric EAC layer 33 is present between electrically conductive layer 34 and recording layer 32. Layers 28 and 34 comprise, if desired, suitable supports for layers 30, 32 and 33. ECI layer 31 separates and is contiguous to layers 32 and 30. A high potential electric field, such as at a voltage within the range of about 0.01 to about 6.0 KV, is established across the photoconductive layer 30 and recording layer 32 through ECI layer 31 by connecting the conductive layers 28 and 34 by connecting means 35 containing power source 36 and switch 38. The electric field across the layers is controlled by switch 38. The latent image formation at latent image sites 40 and 42 is caused by imagewise exposing the photoconductive layer 30 through the conducting layer 28 to exposure means 44, typically actinic radiation, preferably X-ray. The layer 28 and any support for layer 28 must be sufficiently transparent to the exposure means 44 to enable the energy to pass to a desired degree to photoconductive layer 30. The exposure selectively increases the conductivity of the photoconductor layer in those regions exposed to actinic radiation. When switch 38 is in a closed condition, thereby establishing an electric field across the layers, an imagewise current flow is produced through the ECI layer 31 and recording layer 32. The current flow occurs only in those regions of the recording layer 32 in position with the exposed portions of the photoconductive layer 30. After a sufficient charge density, generally less than 1 millicoulomb per square centimeter, preferably about 1.0 microcoulomb/$cm^2$, has been produced in the current exposed portions of the recording layer 32, switch 38 is opened, thereby disrupting the current flow.

The described technique for application of voltage across the photoconductive and recording layers is illustrative. A variety of techniques known in the recording art are useful and are intended to be included in this description. For example, a grid control corona discharge means, not shown, such as described in U.S. Pat. No. 3,370,212, can be substituted for the voltage source and conducting layer 28.

To develop the latent image in latent image sites 40 and 42, the recording element containing layers 32, 33 and 34 is moved away from the ECI layer 31. Connecting means 35 is also disconnected. The recording element illustrated in FIG. 4 is then contacted with a heating means, such as a heated platen 52 illustrated in FIG. 4. The heat from the platen 52 passes through the layer 50 and polymeric EAC layer 47 to the layer 48 containing a latent image to produce a visible image 49. The heating is preferably carried out substantially uniformly by merely positioning the recording element in heat transfer relationship with the heated platen 52. After the development of the desired image, the recording element is removed from the platen.

An especially useful example of the invention is illustrated in FIG. 5 in the drawings. In FIG. 5, the charge-sensitive recording arrangement consists of a support 53 having thereon a polymeric subbing layer 54, such as a poly(alkyl acrylate-co-vinylidene chloride-co-itaconic acid) subbing layer, having thereon an electrically conductive layer 55, generally consisting of a cermet composition, having thereon a polymeric EAC layer 56. The subbing layer 54 helps the conductive layer 55 adhere to the support 53. On the polymeric EAC layer 56 is coated image recording layer 57 containing an image forming combination including a dye-forming coupler. An ECI layer 58 is present between image recording layer 57 and a lead monoxide photoconductive layer 59. The layer 59 has a nickel electrically conductive layer 60 which is on a subbing layer 61 on a transparent film support 64. Developable nuclei are formed in image recording layer 57 by imagewise exposure with a suitable radiation source 65, such as a tungsten light source or X-ray source. Switch 66 is in a closed condition at the time of imagewise exposure with the energy source. A high potential electric field, such as at a voltage within the range of about 0.01 to 6.0 KV, is established across the photoconductor and image-recording layers through ECI layer 58 by connecting the conductive layer 60 and the electrically conductive layer 55 by connecting means 69 through a power source 68. The electric field across the layers is controlled by switch 66. After the necessary charge density is established, switch 66 is opened, thereby disrupting the current flow. Imagewise exposure for about 1 second at about 50 foot-candles produces a developable image in image recording layer 57. To develop the resulting latent image, layer 57 is disconnected from connecting means 69 and power source 68 and moved away from the ECI layer 58. The image recording layer 57 is then heated uniformly until the desired image is produced.

The photoconductive layer, such as the layer 59 in FIG. 5, includes various binders and/or sensitizers known in the electrophotographic art. Useful binders are described in, for example, U.S. Pat. No. 2,361,019 and U.S. Pat. No. 2,258,423. Sensitizing compounds useful in the photoconductive layer are described in, for example, U.S. Pat. No. 3,978,335.

The number of variables affecting the resistance of the recording layer affects the choice of an optimum recording material and imaging means. The resistivity values as described herein for particular recording materials are values measured under optimum temperature conditions during exposure.

If desired, the recording element and imaging means according to the invention are readily modified to provide a continuous image recording operation. This is carried out by means of desired control circuitry and continuous transport apparatus, not shown.

The following examples are included for a further understanding of the invention.

EXAMPLE 1

This illustrates an ECI layer on an electrically activatable recording element according to the invention.

The element and layers for this example are similar to those described in FIG. 1. The film support 13 was a poly(ethylene terephthalate) film. The support had thereon a subbing layer, not shown, consisting of poly(-methyl acrylate-co-vinylidene chloride-co-itaconic acid) and a conducting layer, also not shown, consisting of cermet. The EAC layer 11 consisted of poly(methyl acrylate-co-vinylidene chloride).

An electrically conductive silicone rubber coating composition was prepared by dispersing 30 percent by weight of carbon particles having an average particle size of 20–30 milimicrons (Black Pearl L carbon, which is a trade name of and available from the Cabot Corporation, U.S.A.) in a 50 percent by weight solution of silicone (RTV 602 silicone, which is a trade name of and available from the General Electric Company, U.S.A.) in toluene. The silicone rubber had a volume resistivity of $1\times10^{13}$ Min ohm-cm (500 V.) and was clear and colorless. A curing catalyst (SRC-05, which comprises tetramethylguanidine and alkyldimethylamine and is a trade name of General Electric Co., U.S.A.) was added to the silicone to produce a pliable material after coating. This composition was coated at a 250 micron wet coating thickness on a support and allowed to cure to form a pliable electrically conductive layer (ECI layer). This resulting electrically conductive layer 12 was laminated onto layer 10 as illustrated in FIG. 1.

The coating composition for the image recording layer 10 contained the following:

- silver 3-amino-5-benzylthio-1,2,4-triazole (1.5:1 ligand to silver ion ratio) (dispersed in 1 percent gelatin) (organic silver salt oxidizing agent): 16.0 ml
- methyl mercaptotriazole (1 percent solution in ethanol) (anti-foggant): 0.6 ml
- 4-phenyl-3-imino-5-thiourazole (1 percent solution in ethanol) (development accelerator): 0.6 ml
- surfactant (Surfactant 10 G, which is a polyglycidol ether and is a trademark of and available from the Olin Corporation, U.S.A.) (10 percent solution in water): 0.2 ml
- 4-amino-methoxy-N,N,5-trimethylaniline sulfate (reducing agent): 75 mg dissolved in 1 ml of water)
- 2′,6′-dihydroxytrifluoroacetanilide (dye-forming coupler): 128 mg dissolved in 1 ml of water)
- poly(acrylamide-co-1-vinylimidazole)(90:10 ratio) (5.6 percent by weight in water) (binder): 1.0 ml The coating composition for the image recording layer contained about 0.09 to 0.1 mg of silver per square centimeter of support.

Electrical exposure (1.2 seconds) was made with simultaneous application of a voltage of 50 positive volts to the resulting configuration shown in FIG. 1. The intensity and duration of electrical exposure were sufficient to produce a developable latent image in the recording layer 10.

After exposure, the ECI layer was separated from the remainder of the element containing the image recording layer. The image recording layer was uniformly heated for 10 seconds at 180° C. This produced a silver image and dye image in the exposed areas of the recording layer. A 1.1 image density above fog was observed in the exposed areas of the image recording layer.

EXAMPLE 2

This is a comparative example.

The procedure described in Example 1 was repeated, with the exception that the ECI layer was omitted. No image density was developed in layer 10.

This example illustrates that the ECI layer of Example 1 provides an element that has increased sensitivity compared to the element of Example 2 containing no ECI layer.

EXAMPLE 3

A useful example of an ECI layer on an electrically activatable recording element according to the invention is as follows: The element and layers for this example are similar to those described in FIG. 5. The film support 53 and film support 64 are poly(ethylene terephthalate) film supports. The subbing layers 54 and 61 consist of poly(methyl acrylate-co-vinylidene chloride-co-itaconic acid). The conducting layer 55 consists of cermet. The EAC layer 56 consists of poly(methyl acrylate-co-vinylidene chloride). An electrically conductive silicone rubber coating composition is prepared as described in Example 1. This silicone rubber composition is coated at a 250 micron wet coating thickness on an image recording layer 57 of the electrically activatable recording element and allowed to cure to form a pliable electrically conductive layer (ECI layer).

The coating composition for the image recording layer 57 is similar to the composition of layer 10 in FIG. 1 and contains about 0.09 to 0.1 mg of silver per square centimeter of support.

The layer 59 consists of a 17 micron thick coating of a composite type organic photoconductor consisting essentially of an aggregate organic photoconductor as described in U.S. Pat. No. 3,615,414 as the photoconductive compound.

Visible light exposure imagewise (1.2 seconds) is made with simultaneous application of a voltage of 50 positive volts to the resulting sandwich shown in FIG. 5. The intensity and duration of light exposure are sufficient to produce a developable latent image in the recording layer 57.

After imagewise exposure, the photoconductive layer and the ECI layer are separated from the remainder of the element containing the image recording layer. The image recording layer is uniformly heated for 10 seconds at 180° C. This produces a silver image and dye image in the exposed areas of the recording layer.

The invention has been described in detail with particular reference to preferred embodiments thereof, but it will be understood that variations and modifications can be effected within the spirit and scope of the invention.

What is claimed is:

1. In an electrically activatable recording element comprising an electrically conductive support having thereon, in sequence:

(a) an electrically activatable recording layer, (b) a photoconductive layer, and (c) an electrically conductive layer, the improvement wherein the electrically activatable recording layer (a) and photoconductive layer (b) are separated by an electrically conductive interlayer comprising electrically conductive particles uniformly dispersed in an electrically insulating binder.

2. An electrically activatable recording element as in claim 1 wherein said interlayer comprises electrically conductive, finely divided carbon particles uniformly dispersed in an electrically insulating binder.

3. An electrically activatable recording element as in claim 1 wherein said interlayer comprises electrically conductive, finely divided carbon particles uniformly dispersed in an electrically insulating silicone rubber.

4. An electrically activatable recording element as in claim 1 wherein said interlayer comprises about 10 mg to about $10^5$ mg of electrically conductive finely divided particles per square meter of support, said particles being uniformly dispersed in electrically insulating binder, there being about 10 mg to about $10^5$ mg of binder per square meter of support.

5. An electrically activatable recording element as in claim 1 wherein said interlayer is about 0.1 micron to about 500 microns thick.

6. An electrically activatable recording element as in claim 1 wherein said interlayer is a self-supporting film.

7. In an electrically activatable recording element comprising an electrically conductive support having thereon, in sequence:

(a) a polymeric electrically active conductive layer, (b) an electrically activatable recording layer comprising:
(A) a dye-forming coupler, and
(B) an oxidation-reduction imaging combination comprising:
(i) an organic silver salt oxidizing agent with
(ii) a reducing agent which, in its oxidized form, forms a dye with said dye-forming coupler,
(c) a photoconductive layer, and
(d) an electrically conductive layer, the improvement wherein electrically activatable recording layer (b) and photoconductive layer (c) are separated by a self-supporting, electrically conductive film comprising electrically conductive, finely divided carbon particles uniformly dispersed in electrically insulating silicone rubber.

8. In an electrically activatable recording element comprising a poly(ethylene terephthalate) film support having thereon an electrically conductive cermet layer and having on said cermet layer, in sequence:
(a) a polymeric electrically active conductive layer comprising poly(ethylene:2,2-dimethyl-1,3-propylene 50:50-2,5-dibromoterephthalate),
(b) an electrically activatable recording layer comprising, in an electrically conductive polyacrylamide binder,
(A) a dye-forming coupler consisting essentially of a compound selected from the group consisting of 2,6-dihydroxyacetanilide and 2′,6′-dihydroxytrifluoroacetanilide and combinations thereof, and
(B) an oxidation-reduction combination consisting essentially of:
(i) an organic silver salt oxidizing agent consisting essentially of a silver salt of 3-amino-5-benzylthio-1,2,4-triazole, with
(ii) a reducing agent consisting essentially of 4-amino-2-methoxy-N,N,5-trimethylaniline sulfate,
(c) a photoconductive layer, and
(d) an electrically conductive layer, the improvement which comprises, between (b) and (c), a separable, self-supporting pliable electrically conductive film comprising electrically conductive, finely divided carbon particles uniformly dispersed in electrically insulative silicone rubber.

9. In an electrically activatable recording element comprising an electrically conductive support having thereon, in sequence:
(a) an electrically activatable recording layer, and
(b) an overcoat layer,
the improvement which comprises: as said overcoat layer, a separable, pliable, electrically conductive layer comprising electrically conductive, finely divided particles uniformly dispersed in an electrically insulating binder.

10. An electrically activatable recording element as in claim 9 wherein said overcoat layer comprises electrically conductive, finely divided carbon particles uniformly dispersed in an electrically insulating binder.

11. An electrically activatable recording element as in claim 9 wherein said overcoat layer comprises electrically conductive, finely divided carbon particles uniformly dispersed in an electrically insulating silicone rubber.

12. An electrically activatable recording element as in claim 9 wherein said overcoat comprises about 2 mg to about $10^5$ mg of electrically conductive finely divided particles per square meter of support, said particles being uniformly dispersed in electrically insulating binder, there being about 10 mg to about $10^5$ mg of binder per square meter of support.

13. An electrically activatable recording element as in claim 9 wherein said overcoat is about 0.1 micron to about 50 microns thick.

14. An electrically activatable recording element as in claim 9 wherein said overcoat is a separable, self-supporting film.

15. In an electrically activatable recording element comprising an electrically conductive support having thereon, in sequence:
(a) a polymeric electrically active conductive layer,
(b) an electrically activatable recording layer comprising:
(A) a dye-forming coupler, and
(B) an oxidation-reduction imaging combination comprising:
(i) an organic silver salt oxidizing agent with
(ii) a reducing agent which, in its oxidized form, forms a dye with said dye-forming coupler, and
(c) an overcoat layer,
the improvement which comprises: as said overcoat layer, a separable, self-supporting, pliable, electrically conductive film comprising electrically conductive, finely divided carbon particles uniformly dispersed in electrically insulative silicone rubber.

16. In an electrically activatable recording element comprising a poly(ethylene terephthalate) film support having thereon an electrically conductive cermet layer and having on said cermet layer, in sequence:
(a) a polymeric electrically active conductive layer comprising poly(ethylene:2,2-dimethyl-1,3-propylene 50:50-2,5-dibromoterephthalate),
(b) an electrically activatable recording layer comprising, in an electrically conductive polyacrylamide binder,
(A) a dye-forming coupler consisting essentially of a compound selected from the group consisting of 2,6-dihydroxyacetanilide and 2′,6′-dihydroxytrifluoroacetanilide and combinations thereof, and
(B) an oxidation-reduction combination consisting essentially of:
(i) an organic silver salt oxidizing agent consisting essentially of a silver salt of a 3-amino-5-benzylthio-1,2,4-triazole, with
(ii) a reducing agent consisting essentially of 4-amino-2-methoxy-N,N5-trimethylaniline sulfate, and
(c) an overcoat layer,
the improvement which comprises: as said overcoat layer, a separable, self-supporting, pliable, electrically conductive film comprising electrically conductive, finely divided carbon particles uniformly dispersed in electrically insulative silicone rubber.

17. A dry, electrically activatable recording process for producing an image in an electrically activatable recording element comprising, in sequence:
(a) a first electrically conductive support,
(b) a photoconductive layer,
(c) an electrically conductive, pliable interlayer comprising electrically conductive particles uniformly dispersed in an electrically insulating binder,
(d) an electrically activatable recording layer, and
(e) a second electrically conductive support, said process comprising the steps of:

(I) imagewise altering the conductivity of said photoconductive layer in accord with an image to be recorded;

(II) applying an electrical potential across said photoconductive layer and said recording layer of a magnitude and for a time sufficient to produce a latent image in said recording layer corresponding to the image to be recorded; and (III) heating said recording layer substantially uniformly at a temperature and for a time sufficient to produce a developed image in said recording layer.

18. A dry, electrically activatable recording process as in claim 17 wherein, prior to said heating step in (III), the electrically activatable recording layer (d) and said second support are separated from the remainder of said recording element, after which the separated support and layer are heated as in (III).

19. A dry, electrically activatable recording process as in claim 17 wherein said recording layer is heated in (III) to a temperature within the range of about 100° C. to about 180° C. until an image is developed in said recording layer.

20. A dry, electrically activatable recording process for producing a dye enhanced silver image in an electrically activatable recording element comprising, in sequence:

(a) a first electrically conductive support, (b) a photoconductive layer, (c) a separable, electrically conductive interlayer comprising electrically conductive, finely divided carbon particles uniformly dispersed in an electrically insulating binder, (d) an electrically activatable recording layer comprising, in an electrically conductive binder, (A) a dye-forming coupler, and (B) an oxidation-reduction combination comprising:

(i) an organic silver salt oxidizing agent, with (ii) a reducing agent which, in its oxidized form, forms a dye with said dye-forming coupler, (e) an electrically activatable conductive layer, and (f) a second electrically conductive support, said process comprising the steps of:

(I) imagewise altering the conductivity of said photoconductive layer in accord with an image to be recorded;

(II) applying an electrical potential across said photoconductive layer and said recording layer of a magnitude and for a time sufficient to produce a latent image in said recording layer corresponding to the image to be recorded; and (III) heating said recording layer substantially uniformly at a temperature and for a time sufficient to produce a dye enhanced silver image in said recording layer.

21. A dry, electrically activatable recording process for producing a developed image in an electrically activatable recording element comprising the steps of:

(I) imagewise altering the conductivity of a photoconductive layer in accord with an image to be recorded;

(II) positioning the imagewise altered photoconductive layer from (I) on:

(a) a separable, electrically conductive interlayer comprising electrically conductive, finely divided particles uniformly dispersed in a pliable, electrically insulating binder, which is positioned on an electrically activatable recording element comprising:

(b) an electrically activatable recording layer on (c) an electrically conductive support; and (III) applying an electrical potential across said photoconductive layer and recording layer of a magnitude and for a sufficient time to produce a latent image in the areas of said recording layer corresponding to the imagewise altered portions of said photoconductive layer; and (IV) uniformly heating the recording element at a temperature and for a time sufficient to produce a developed image in said recording layer.

22. A dry, electrically activatable recording process as in claim 21 comprising the steps:

(V) positioning said imagewise altered photoconductive layer on said pliable interlayer, which is positioned on a second electrically activatable recording layer; then (VI) applying an electrical potential across said photoconductive layer and said second recording layer of a magnitude and for a sufficient time to produce a latent image in the areas of said recording layer corresponding to the imagewise altered portions of said photoconductive layer; and (VII) uniformly heating said second recording layer at a temperature and for a time sufficient to produce a developed image in said second recording layer.

23. A dry, electrically activatable recording process for producing a dye enhanced silver image in an electrically activatable recording element comprising, on an electrically conductive support, in sequence:

(a) a polymeric electrically active conductive layer, (b) an electrically activatable recording layer comprising:

(A) a dye-forming coupler, and (B) an oxidation-reduction combination comprising:

(i) an organic silver salt oxidizing agent with (ii) a reducing agent which, in its oxidized form, forms a dye with said dye-forming coupler, having thereon:

(c) a separable, electrically conductive, film interlayer comprising electrically conductive particles dispersed in an electrically insulating binder, said process comprising the steps of:

(I) positioning a photoconductive element comprising an electrically conductive support on said film interlayer;

(II) imagewise exposing said photoconductive element to actinic radiation while simultaneously applying an electrical potential of sufficient magnitude and for a sufficient time across said photoconductive element and said recording element to produce a latent image in the areas of said recording layer corresponding to the exposed areas of said photoconductive element; and (III) substantially uniformly heating the recording element at a temperature and for a time sufficient to produce a dye enhanced silver image in said recording element.

24. A process as in claim 23 wherein said recording element in (III) is heated to a temperature within the range of about 100° C. to about 180° C. until a dye enhanced silver image is produced.

* * * * *